US005525209A

United States Patent [19]

Billon et al.

[11] Patent Number: 5,525,209

[45] Date of Patent: Jun. 11, 1996

[54] PROCESS FOR THE IMPROVED PRODUCTION OF MIDDLE DISTILLATES JOINTLY WITH THE PRODUCTION OF HIGH VISCOSITY OILS WITH HIGH VISCOSITY INDICES FROM HEAVY PETROLEUM CUTS

[75] Inventors: Alain Billon, Le Vesinet; Jean-Pierre Peries, Saint Genis Laval; Pierre-Henri Bigeard, Vienne, all of France

[73] Assignee: Institut Francais Du Petrole, Rueil Malmaison, France

[21] Appl. No.: 330,820

[22] Filed: Oct. 24, 1994

[30] Foreign Application Priority Data

Oct. 25, 1993 [FR] France ..... 93 12856

[51] Int. Cl.[6] ..... C01G 65/18

[52] U.S. Cl. ..... 208/059; 208/57; 208/89

[58] Field of Search ..... 208/59, 57, 89

[56] References Cited

U.S. PATENT DOCUMENTS

| | | | |
|---|---|---|---|
| 3,385,781 | 5/1968 | Hamner et al. | 208/59 |
| 4,689,137 | 8/1987 | Clark | 208/59 |
| 4,797,195 | 1/1989 | Kukes et al. | 208/59 |
| 4,875,991 | 10/1989 | Kukes et al. | 208/59 |
| 4,940,530 | 7/1990 | Kukes et al. | 208/89 |
| 5,198,099 | 3/1993 | Trachte et al. | 208/89 |

FOREIGN PATENT DOCUMENTS

| | | |
|---|---|---|
| 0101177 | 2/1984 | European Pat. Off. . |
| 0182216 | 5/1986 | European Pat. Off. . |
| 2038374 | 1/1971 | France . |
| 2077334 | 10/1971 | France . |
| 2017287 | 10/1970 | Germany . |

*Primary Examiner*—Helane Myers

*Attorney, Agent, or Firm*—Millen, White, Zelano, & Branigan

[57] ABSTRACT

A process for the joint production of middle distillates and oil bases (viscosity index between 95 and 150) particularly from vacuum distillates and/or deasphalted oils, comprises a first step in which the feedstock is brought into contact with an amorphous catalyst containing at least one metal or metallic compound with a hydro-dehydrogenating function, such as Ni, Mo, W or Co, at a temperature of between 350° C. and 430° C., a pressure of between 5 and 20 MPa, a space velocity of between 0.1 and 5 $h^{-1}$ in the presence of hydrogen in a ratio $H_2$/HC of 150 to 2,000 by volume. The product from the first step is brought into contact in a second step with a second catalyst comprising a support, a Y zeolite, at least one group VIB element and at least one group VIII metal at a temperature of between 350° C. and 430° C., a pressure of between 5 and 20 MPa and a space velocity of between 0.1 and 5 $h^{-1}$.

22 Claims, No Drawings

PROCESS FOR THE IMPROVED PRODUCTION OF MIDDLE DISTILLATES JOINTLY WITH THE PRODUCTION OF HIGH VISCOSITY OILS WITH HIGH VISCOSITY INDICES FROM HEAVY PETROLEUM CUTS

BACKGROUND OF THE INVENTION

The invention concerns the joint production, from heavy petroleum cuts, of middle distillates and high viscosity oil bases, ie., oils with viscosity indices (VI) of between 95 and 150, more particularly between 120 and 140.

The boiling points of the feedstocks are more than 380° C., for example vacuum distillates, deasphalted oils or mixtures thereof.

The Institut Francais du Pétrole has been developing processes for the production of oil bases from these feedstocks for a long time, whether by extraction (using furrural, for example) or by hydroraffination. In the latter case, amorphous catalysts containing nickel and molybdenum supported on alumina or an aluminosilicate are used (French patent FR-A-1 465 372).

A two step process using two different amorphous catalysts is also known. Thus in U.S. Pat. No. US-A-3 642 612, the feedstock is treated in the presence of hydrogen using a first catalyst containing metals from groups VI and VIII deposited on a slightly acid support (alumina) then using a second catalyst also containing metals from groups VI and VIII but deposited on a more acidic support (silica-alumina).

We have produced oil bases with at least the same VIs as those produced by a process using amorphous catalysts, but having higher viscosities (with respect to a process using amorphous catalysts) for isoconversion to distillates.

In other words, this process allows more middle distillate production while conserving the characteristics of similar oils.

We have developed a flexible process which can be adapted for a variety of cuts and which allows the refiner to control conversion and viscosity.

More precisely, the invention provides a process for the treatment of heavy hydrocarbon petroleum cuts with a boiling point of more than 380° C., for the improved production of middle distillates jointly with the production of oil bases with a viscosity index of between 95 and 150, wherein, in a first step, the cut is brought into contact in the presence of hydrogen with at least one catalyst containing, on an amorphous support, at least one group VI element and at least one group VIII element, at a temperature of between 350° C. and 430° C., a pressure of between 5 and 20 MPa, the space velocity being between 0.1 and 5 $h^{-1}$ and the quantity of hydrogen introduced being such that the ratio of hydrogen/hydrocarbon is between 150 and 2,000 by volume, the product from said first step then being brought into contact, in a second step, with a catalyst containing a support, at least one group VI element, at least one group VIII element and a zeolite Y, at a temperature of between 350° C. and 430° C., a pressure of between 5 and 20 MPa, the space velocity being between 0.1 and 5 $h^{-1}$ and the product from said second step then being fractionated into middle distillates and a residue containing the oil bases.

In the first step of the process, the feedstock and added hydrogen are brought into contact with a first catalyst. The quantity of hydrogen added is such that the ratio of H/hydrocarbon is between 150 and 2,000, preferably between 500 and 1,500 by volume.

The catalyst for the first step is essentially constituted by a non zeolitic support and at least one metal or metallic compound which has a hydro-dehydrogenating function.

The support is preferably essentially constituted (based on) amorphous alumina or silica-alumina; it can also contain boron oxide, magnesia, zirconia, titanium oxide, clay or a mixture of these oxides. The hydro-dehydrogenating function is preferably supplied by at least one metal or metallic compound from the group molybdenum, tungsten, nickel and cobalt. In general, a combination of group VI metals from the periodic classification of the elements (in particular molybdenum and/or tungsten) can be used.

The catalyst can advantageously contain phosphorous: the compound is known to have two advantages when used in hydrotreatment catalysts: ease of preparation in particular during impregnation of nickel and molybdenum solutions, and higher hydrogenation activity.

Preferred catalysts are NiMo on alumina, NiMo on alumina doped with boron and/or phosphorous and NiMo on silica-alumina.

Advantageously, alumina z or o are chosen.

The total concentration of metal oxides from groups VI and VIII is between 5% and 40% by weight, preferably between 7% and 30% and the weight reatio expressed as metallic oxide between group VI metal (or metals) and group VIII metal (or metals) is between 20 and 1.25, preferably between 10 and 2. The concentration of phosphorous oxide $P_2O_5$ is less than 15 weight %, preferably less than 10 weight %.

The use of a catalyst which favours hydrogenation over cracking during the first step, used under appropriate thermodynamic and kinetic conditions, greatly reduces the content of condensed polycyclic aromatic hydrocarbons. Under these conditions, a major portion of the nitrogen-containing products in the feedstock are also transformed. This operation thus eliminates two types of compounds which are known to inhibit the zeolite catalyst.

As is normal, the first step is carried out at temperatures between 350° C. and 430° C., preferably between 370° C. and 410° C., pressures of between 5 and 20 MPa, preferably 7 and 15 MPa, and space velocities of between 0.1 and 5 $h^{-1}$, preferably between 0.3 and 1.5 $h^{-1}$.

Advantageously, the refiner selects the temperature for the first step depending on the viscosity index desired for the oil base at the exit to this step, preferably between 90 and 130, more preferably between 90 and 120, most preferably between 90 and 110.

The product obtained from the first step is passed across a second catalyst in a second step. Advantageously, the effluent is sent to the second step without intermediate separation of ammonia and hydrogen sulphide. A further embodiment of the process could include this separation step.

The catalyst for the second step is mainly constituted by a zeolite, a support and a hydro-dehydrogenating function.

The hydro-dehydrogenating function is constituted by a combination of metals from group VI (in particular molybdenum and/or tungsten) and metals from group VIII (in particular cobalt and/or nickel) of the periodic classification of the elements. Advantageously, the catalyst may also contain phosphorous.

The total concentration of GVII and VI metal oxides is between 1% and 40% by weight, preferably between 3% and 30% and advantageously between 8–40%, more preferably 10–40% and most preferably 10–30%. The weight ratio, expressed as metal oxides, between group VI metal (or metals) and group VIII metal (or metals) is between 20 and 1.25, preferably between 10 and 2. The phosphorous oxide ($P_2O_5$) concentration is less than 15%, preferably less than 10 weight %.

The support is selected from the group constituted by alumina, silica, silica-alumina, alumina-boron oxide, magnesia, silica-magnesia, zirconia, titanium oxide and clay, either alone or as a mixture.

The weight content of zeolite is between 2 and 80%, preferably between 3 and 50% with respect to the final catalyst, advantageously between 3–25%.

The zeolite can advantageously be doped with metallic elements such as rare earth elements, in particular lanthanum and cerium, or noble or non noble metals from group VIII, such as platinum, palladium, ruthenium, rhodium, iridium, iron and other metals such as manganese, zinc or magnesium.

An acid zeolite HY is particularly advantageous and is characterised by different specifications: a molar ratio $SiO_2/Al_2O_3$ of between about 8 and 70, preferably between about 12 and 40: a sodium content of less than 0.15 weight % determined on calcined zeolite at 1,100° C.; one crystalline dimension has a primary lattice of between $24.55\times10^{-10}$ m and $24.24\times10^{-10}$ m, preferably between $24.38\times10^{-10}$ m and $24.26\times10^{-10}$; a sodium ion removal capacity $C_{Na}$, expressed in grams of Na per 100 grams of modified , neutralised and calcined zeolite, of greater than about 0.85; a specific surface area, determined by the BET method, of greater than about 400 $m^2/g$, preferably more than 550 $m^2/g$, a water vapour adsorption capacity at 25° C. at a partial pressure of 2.5 torr (34.6 MPa) of greater than about 6%, a pore distribution comprising between 1% and 20%, preferably between 3% and 15% of the pore volume contained in pores with a diameter between $20\times10^{-10}$ m and $80\times10^{-10}$ m, the remainder of the pore volume being contained in pores with a diameter of less than $20.10^{-10}$m.

A preferred catalyst contains nickel, molybdenum, a zeolite Y as defined above and alumina.

The operating conditions for the second step are important.

The pressure is maintained between 5 and 20 MPa, preferably 7 to 15 MPa, the space velocity being between 0.1 and 5 $h^{-1}$, preferably between 0.3 and 1.5 $h^{-1}$.

The temperature is adjusted for the second step to produce the desired viscosity and VI. It is between 350° C. and 430° C., advantageously generally between 370° C. and 410° C., more preferably 390° C.

We have discovered, surprisingly, that the viscosity of the residue is reduced less than when using amorphous catalysts for the same level of conversion.

Thus, by combining regulation of the conditions in the first step to produce an intermediate viscosity and viscosity index, with regulation of the conditions in the second step to allow the viscosity and VI to be adjusted to the desired values, we have discovered a novel and surprising process for the manufacture of high viscosity oils with high VIs along with middle distillates.

The product from the second step is then fractionated to obtain middle distillates and a residue containing the oil bases.

Preferably, the process is carried out without recirculating the residue to avoid accumulation of polyaromatic compounds.

Nevertheless, the process can recycle a portion of the residue from the second step. The recycled fraction is then mixed with the product from the first step.

The process and its advantages will be better understood from the following examples.

EXAMPLE 1

A feedstock constituted by a vacuum distillate with the composition given in Table 1 was introduced into a reactor containing an amorphous catalyst (15% Mo, 5% Ni, 80% alumina). Hydrogen was introduced at a pressure of 14 MPa in the ratio $H_2$/HC=1,300 by volume. The space viscosity was 0.5 $h^{-1}$.

The characteristics of the oils obtained at different temperatures are given in Table I.

EXAMPLE 2

A catalyst containing 12% Mo, 4% Ni and 10% zeolite on alumina was loaded into a second reactor positioned after the first reactor.

The product from the first reactor was introduced into the second reactor.

The pressure was 14 MPa and the product circulated at a space velocity of 1 $h^{-1}$.

The 380° C.+ residue was recovered than vacuum distilled.

Table 2 compares the process of the invention with a single step process using an amorphous catalyst for the production of high viscosity oils with a high viscosity index (VI) (VI>125) and middle distillates from a vacuum distillate.

It can be seen that:

for an identical conversion rate (68.7%), the oil obtained using the process of the invention has a higher viscosity ($5.10^{-4}$ $m^2/s$ instead of $4.5.10^{-4}$ $m^2/s$) and is also produced at much lower temperatures;

TABLE I

| | Feed Stock | Example 2 | | | Example 1 | | Example 5 |
|---|---|---|---|---|---|---|---|
| Temperatures | | | | | | | |
| 1st step | | 390° C. | 390° C. | 390° C. | 410° C. | 395° C. | 395° C. |
| 2nd step | | 380° C. | 375° C. | 370° C. | — | — | 390° C. |
| Conversion wt % | | 90% | 80% | 68.7% | 68.7% | 56.2% | 68.7% |
| Material Balance (wt %) | | | | | | | |
| H2S + NH3 | | 3.0 | 3.0 | 3.0 | 3.0 | 3.0 | 3.0 |

TABLE I-continued

| | Feed Stock | Example 2 | | | Example 1 | | Example 5 |
|---|---|---|---|---|---|---|---|
| C1–C4 | | 4.1 | 3.6 | 2.5 | 3.6 | 2.4 | 3.5 |
| C5–C150 | | 26.9 | 21.8 | 15.7 | 13.5 | 9.6 | 13.0 |
| 150–380 | | 56.0 | 51.6 | 47.5 | 48.7 | 41.2 | 49.2 |
| 380+ | 100 | 12.8 | 22.6 | 33.7 | 33.7 | 46.0 | 33.65 |
| Total | 100 | 102.8 | 102.6 | 102.4 | 102.4 | 102.2 | 102.35 |
| Dewaxed 390 residue | | | | | | | |
| d15/4 | 0.935 | | | | | | |
| V 100° C. (m2/s) | $9.5.10^{-4}$ | $3.6.10^{-4}$ | $4.5.10^{-4}$ | $5.0.10^{-4}$ | $4.5.10^{-4}$ | $5.0.10^{-4}$ | $4.5.10^{-4}$ |
| VI | 50 | 132 | 133 | 125 | 134 | 125 | 133 |
| Pour point (°C.) | −18 | −18 | −18 | −18 | −18 | −18 | −18 |

the same oil base (viscosity $5.0.10^{-4}$ $m^2/s$ and VI=125) was obtained with much higher joint production of middle distillates in the process of the invention (47.5% as regards 41.2%, ie., a gain of more than 15%);

the increased conversion yield in the process of the invention was not to the detriment of the viscosity of the dewaxed oil: the middle distillate yield could be increased by 10% without altering the viscosity.

EXAMPLE 3

A deasphalted vacuum residue (viscosity at 100° C. generally between $25.10^{-4}$ to $90.10^{-4}$ $m^2/s$) was introduced into a reactor containing the same catalyst as in Example 1, under the same pressure and space viscosity conditions.

The characteristics of the oil bases obtained at different temperatures from a residue with a viscosity of $50.10^{-4}$ $m^2/s$ are given in Table II. The 380° C.+ residue was distilled to produce very viscous bright stock oil (viscosity at 100° C. greater than or equal to $32.10^{-4}$ $m^2/s$).

EXAMPLE 4

The product from Example 3 was treated as described for Example 2.

The results are shown in Table II.

Table II compares the process of the invention with a single step process using an amorphous catalyst for the production of very viscous bright stock oils (viscosity $\geqq 32.10^{-4}$ $m^2/s$) and middle distillates from a deasphalted vacuum residue.

TABLE II

| | Feed Stock | Example 4 | | | Example 3 | |
|---|---|---|---|---|---|---|
| Temperatures | | | | | | |
| 1st step | | 390° C. | 390° C. | 390° C. | 395° C. | 410° C. |
| 2nd step | | 370° C. | 375° C. | 380° C. | — | — |
| Conversion wt % | | 40% | 60% | 80% | 40% | 60% |
| Material Balance (wt %) | | | | | | |
| H2S + NH3 | | 2.2 | 2.2 | 2.2 | 2.2 | 2.2 |
| C1–C4 | | 1.0 | 1.6 | 2.5 | 1.5 | 2.9 |
| C5–C150 | | 9.1 | 18.0 | 33.6 | 6.5 | 12.2 |
| 150–390 | | 27.7 | 38.2 | 41.7 | 29.7 | 42.4 |
| 380+ | 100 | 61.5 | 41.8 | 22.2 | 62.0 | 42.3 |
| Light oil | | 39.0 | 28.2 | 16.4 | 55.0 | |
| BS residue | | 22.5 | 13.6 | 5.8 | 7.0 | not possible |
| Total | | 101.5 | 101.8 | 102.2 | 101.7 | 102.0 |
| Dewaxed 380 residue | | | | | | |
| d15/4 | 0.945 | 0.865 | 0.860 | 0.855 | 0.849 | 0.845 |
| V 100° C. (m2/s) | $50.10^{-4}$ | $13.6.10^{-4}$ | $12.6.10^{-4}$ | $11.4.10^{-4}$ | $9.8.10^{-4}$ | $7.2.10^{-4}$ |
| VI | 80 | 114 | 116 | 118 | 125 | 136 |
| Pour point (°C.) | −18 | −18 | −18 | −18 | −18 | −18 |
| BS vacuum | | 570° C. | 575° C. | 590° C. | 700° C. | |
| distillate | | | | | | |
| d15/4 | | 0.875 | 0.874 | 0.872 | 0.865 | |
| V 100° C. (m2/s) | | $32.10^{-4}$ | $32.10^{-4}$ | $32.10^{-4}$ | $32.10^{-4}$ | |
| VI | | 108 | 105 | 106 | | |
| Pour point | | <−18 | <−18 | <−18 | | |

It can be seen that only low conversions (<40%) of these oils can be obtained with processes using amorphous catalysts, since industrial distillation at 700° C. is practically impossible.

The process of the invention, however, uses convenient distillation temperatures (of the order of 570°–590° C.) to produce very viscous oils. The quantities of middle distillates jointly produced covers a wide range.

The above examples demonstrate the great flexibility of the process of the invention which allows the refiner to produce a wide range of oil bases accompanied by higher quality middle distillates depending on the feedstock and operating conditions selected.

The smoke point of kerosenes obtained from Examples 2 and 4 is greater than 25 mm and of the order of 20 in Examples 1 and 3.

The aromatic content in the gas oil is below 10% in Examples 2 and 4 and 20% in Examples 1 and 3.

EXAMPLE 5 (comparative)

The product obtained from Example 1 was passed into a second reactor containing a 15% Mo, 5% Ni and silica-alumina (48% alumina and 32% silica) catalyst.

The pressure was 14 MPa and the space velocity was 1 $h^{-1}$.

The characteristics of the product obtained are given in Table I.

This test, carried out using the conditions described in U.S. Pat. No. US-A-3 642 612, showed that the invention described in the present application produces novel and surprising results with respect to known techniques.

We claim:

1. A process for the treatment of heavy hydrocarbon petroleum cuts with a boiling point of more than 380° C., for the improved production of middle distillates jointly with the production of oil bases with a viscosity index of between 95 and 150, wherein, in a first step, the cut is brought into contact in the presence of hydrogen with at least one hydrogenation and denitrogenation catalyst consisting essentially of, on an amorphous non-zeolite support, at least one group VI element and at least one group VIII element, at a temperature of between 350° C. and 430° C., at a pressure of between 5 and 20 MPa, the space velocity being between 0.1 and 5 $h^{-1}$ and the quantity of hydrogen introduced being such that the ratio of hydrogen/hydrocarbon is between 150 and 2,000 by volume, with the proviso that operating conditions in said first step are sufficient to yield an oil base effluent product having a viscosity index between 90 and 130, with reduced polyaromatic and nitrogen contents, the product from said first step then being brought into contact, in a second step, with at least one catalyst consisting essentially (a) a support selected from the group consisting of alumina, silica, silica-alumina, alumina-boron oxide, magnesia, silica-magnesia, zirconia, titanium oxide and clay, either alone or as a mixture, (b) at least one group VI element, (c) at least one group VIII element, and (d) a Y zeolite, at a temperature of between 350° C. and 430° C., a pressure of between 5 and 20 MPa, the space velocity being between 0.1 and 5 $h^{-4}$ so as to adjust the viscosity and viscosity index of the resultant product, and the product from said second step then being fractionated into middle distillates and a residue containing the oil bases.

2. A process according to claim 1, wherein the heavy fractions are selected from the group formed by vacuum distillates, deasphalted oils and mixtures thereof.

3. A process according to claim 1, wherein the non-zeolite amorphous support is selected from the group consisting of alumina and silica-alumina.

4. A process according to claim 3, wherein the amorphous non-zeolite support further comprises at least one compound selected from the group consisting of boron oxide, magnesia, zirconia, titanium oxide and clay.

5. A process according to claim 1 wherein the catalyst for the first step also contains phosphorous in a proportion of less than 15% by weight of phosphorous oxide.

6. A process according to claim 1, wherein the catalyst for the first step comprises at least one VIII metal selected from the group consisting of nickel and cobalt, and at least one GVI metal selected from the group consisting of molybdenum and tungsten.

7. A process according to claim 1, wherein the catalyst for the first step has a total concentration of oxides of metals from group VI and VIII of between 5% and 50% by weight and in that the weight ratio expressed as group VI metal oxide to group up VIII metal oxide is between 20 and 1.25.

8. A process according to claim 1 wherein, in the first step, the temperature is between 370° C. and 410° C., the pressure is 7 to 15 MPa, the space velocity is 0.3 to 1.5 $h^{-1}$ and the volume ratio of $H_2$/hydrocarbons is between 500 and 1,500.

9. A process according to claim 1, wherein the catalyst for the second step comprises at least one group VIII metal selected from the group consisting of nickel and cobalt, and at least one group VI metal selected from the group consisting of molybdenum and tungsten.

10. A process according to claim 1 wherein the catalyst for the second step also comprises phosphorous.

11. A process according to claim 1, wherein the total concentration of metal oxides in the catalyst for the second step is between 1% and 40% by weight and the weight ratio expressed as group VI metal oxide to group VIII metal oxide is between 20 and 1.25.

12. A process according to claim 1, wherein the zeolite content of the catalyst in the second step is between 2% and 80% by weight.

13. A process according to claim 1, wherein the zeolite is doped with metallic elements selected from the group consisting of rare earth metals, group VIII metals, manganese, zinc and magnesium.

14. A process according to claim 1 wherein the temperature in the second step is between 370° C. and 410° C., the pressure is between 7 and 15 MPa and the space velocity is between 0.3 and 1.5 $h^{-1}$.

15. A process according to claim 1 wherein the catalyst for the second step contains between 3% and 25% by weight of zeolite and between 10% and 40% by weight of group VIII and VI metal oxides.

16. A process according to claim 1 wherein the oil base from the first step has a viscosity index of between 90 and 110.

17. A process according to claim 6, wherein the catalyst for the second step contains between 3% and 25% by weight of zeolite and between 10% and 40% by weight of group VIII and VI metal oxides.

18. A process according to claim 17, wherein the catalyst for the second step also comprises phosphorous.

19. A process according to claim 18, wherein the zeolite is doped with metallic elements selected from the group consisting of rare earth metals, GVIII metals, manganese, zinc and magnesium.

20. A process according to claim 1, wherein the catalyst in the first step is free of zeolite.

21. A process according to claim 1, wherein the effluent from the first step is sent to the second step without an intermediate separation of ammonia and hydrogen sulfide.

22. A process for the treatment of heavy hydrocarbon petroleum cuts with a boiling point of more than 380° C., for the improved production of middle distillates jointly with the production of oil bases with a viscosity index of between 95 and 150, wherein, in a first step, the cut is brought into contact in the presence of hydrogen with at least one hydrogenation and denitrogenation catalyst consisting essentially of, on an amorphous non-zeolite support, at least one group VI element and at least one group VIII element, at a temperature of between 350° C. and 430° C., at a pressure of between 5 and 20 MPa, the space velocity being between 0.1 and 5 $h^{-1}$ and the quantity of hydrogen introduced being such that the ratio of hydrogen/hydrocarbon is between 150 and 2,000 by volume, with the proviso that operating conditions in the first step are sufficient to yield an oil base effluent product having a viscosity index of between 90 and 130, with reduced polyaromatic and nitrogen contents, and the product from said first step then being brought into contact, in a second step, with at least one catalyst consisting essentially of (a) a support selected from the group consisting of alumina, silica, silica-alumina, alumina-boron oxide, magnesia, silica-magnesia, zirconia, titanium oxide and clay, either alone or as a mixture, (b) at least one group VI element, (c) at least one group VIII element, and (d) a Y zeolite, at a temperature of between 350° C. and 430° C., a pressure of between 5 and 20 MPa, the space velocity being between 0.1 and 5 $h^{-1}$ so as to adjust the viscosity and viscosity index of the resultant product pressure of between 5 and 20 MPa, the space velocity being between 0.1 and 5 $h^{-4}$ so as to adjust the viscosity and viscosity index of the resultant product, with the proviso that the product from the first step is sent to the second step without an intermediate separation of ammonia and hydrogen sulfide.

* * * * *